US006253470B1

(12) United States Patent
Depies et al.

(10) Patent No.: US 6,253,470 B1
(45) **Date of Patent: *Jul. 3, 2001**

(54) HYDRAULIC AND ELECTRICAL CONTROL SYSTEMS FOR USE WITH VEHICLE ACCESSORY UNITS

(75) Inventors: Gerald L. Depies, Cedar Grove; Jerald L. Plyer, Saukville; Charles J. Solveson, Hartland, all of WI (US)

(73) Assignee: Douglas Dynamics, Milwaukee, WI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/803,942

(22) Filed: Feb. 21, 1997

(51) Int. Cl.[7] ..... E01H 5/04
(52) U.S. Cl. ..... 37/234; 37/272; 37/283
(58) Field of Search ..... 37/234, 283, 272, 37/273

(56) References Cited

U.S. PATENT DOCUMENTS

| | | | | |
|---|---|---|---|---|
| Re. 33,835 | | 3/1992 | Kime et al. | 239/657 |
| 1,878,080 | * | 9/1932 | Weeks | 37/234 X |
| 1,929,799 | * | 10/1933 | Weeks | 37/234 X |
| 1,997,001 | * | 4/1935 | Lamb | 37/234 X |
| 2,242,472 | * | 5/1941 | Keeler | 37/234 |
| 3,273,730 | * | 9/1966 | Moore | 37/234 X |
| 3,677,604 | * | 7/1972 | Leyrat | 37/234 X |
| 3,706,144 | | 12/1972 | Miceli | 37/42 |
| 3,793,752 | * | 2/1974 | Snyder | 37/234 |
| 4,012,175 | | 3/1977 | Simonds, Jr. | 417/316 |
| 4,028,820 | | 6/1977 | Simonds, Jr. | 37/41 |
| 4,074,448 | * | 2/1978 | Niemela | 37/234 |
| 4,941,275 | * | 7/1990 | Beeley et al. | 37/234 X |
| 4,999,935 | | 3/1991 | Simi et al. | 37/236 |
| 5,177,887 | | 1/1993 | McGugan et al. | 37/236 |
| 5,265,356 | | 11/1993 | Winter | 37/234 |
| 5,285,588 | | 2/1994 | Niemela et al. | 37/234 |
| 5,361,519 | | 11/1994 | Ciula et al. | 37/234 |
| 5,638,618 | * | 6/1997 | Niemela et al. | 37/234 X |

FOREIGN PATENT DOCUMENTS

| | | | | |
|---|---|---|---|---|
| 989165 | * | 5/1976 | (CA) | 37/234 |
| 594390 | * | 6/1959 | (IT) | 37/234 |

* cited by examiner

*Primary Examiner*—Christopher J. Novosad
(74) *Attorney, Agent, or Firm*—Michael Best & Friedrich LLP

(57) ABSTRACT

An hydraulic and electrical control system are provided for an accessory unit such as a vehicle mounted V-plow blade snowplow.

27 Claims, 6 Drawing Sheets

HYDRAULIC AND ELECTRICAL CONTROL SYSTEMS FOR USE WITH VEHICLE ACCESSORY UNITS

FIELD OF THE INVENTION

The invention relates to hydraulic and electrical control systems for use with vehicle accessory units, and more particularly, to hydraulic and electrical control systems for vehicle mounted snowplows such as V-plows.

BACKGROUND OF THE INVENTION

Hydraulic systems for controlling, for example, the operative positions of vehicle mounted snowplow blades are known in the art. The hydraulic systems are generally integrated with electrical systems so as to control the movement of the blade from some sort of control. The controls tend to be difficult for a user to operate as well as have very few programmed features to simplify operation for the user. Further, operation of the controls often results in abrupt movements of the blade that reduce the life of the hydraulic system.

SUMMARY OF THE INVENTION

The invention provides an improved hydraulic system and an improved electrical control system that are both especially suited for use with a vehicle accessory unit. The electrical system employs a programmed microcontroller which simplifies the operation of the accessory unit. The microcontroller is housed in an ergonomic handheld control from which the movement of the accessory unit can be controlled.

The microcontroller is programmed to include function time outs to reduce unnecessary electrical power consumption, to include a power down after a set period of time, to include a lower float delay that enables the user to lower a blade incrementally for up to a set period of time, and a soft stop feature wherein the solenoid valves of the hydraulic system are controlled to reduce the abrupt stops of the hydraulic actuators. The microcontroller is further programmed to control movement of each wing of a V-plow blade. The hydraulic and electrical control systems are controlled by the microcontroller in three modes of operations to simplify operator control. The first mode of operation allows the V-plow to be operated as if it were a typical straight blade plow, the second mode of operation allows the V-plow blade to move into scoop and vee orientations, and the third mode of operation allows each wing of the V-plow blade to be operated independently such that each wing is extendable and retractable.

It is an object of the present invention to provide an improved hydraulic system.

It is another object of the present invention to provide an improved electrical system for the control of a hydraulic circuit.

It is another object of the present invention to provide an improved electrical system having a programmed microcontroller for the control of a hydraulic system.

It is another object of the present invention to provide improved hydraulic and electrical control systems for use with a vehicle accessory unit.

It is another object of the present invention to provide improved hydraulic and electrical control systems for use with a V-plow type accessory unit.

It is another object of the present invention to provide a vehicle accessory unit that improves operator control of the unit.

It is another object of the present invention to provide a vehicle accessory unit that is controllable faster and easier to use.

It is another object of the present invention to provide an electrical control system that prevents inadvertent operation in the event of a system failure.

It is another object of the present invention to provide an electrical control system that reduces unnecessary electrical system power consumption by timing out system functions.

It is another object of the present invention to provide an electrical control system that powers down after a set period of time.

It is another object of the present invention to provide a V-plow with a hydraulic and electrical control system that allows the V-plow to be used as a typical straight blade.

It is another object of the present invention to provide a V-plow with a hydraulic and electrical control system that allows the V-plow to be oriented in scoop or vee positions.

It is another object of the present invention to provide a V-plow with a hydraulic and electrical control system that allows each wing of the V-plow to be independently extended and retracted.

It is another object of the present invention to provide a vehicle accessory unit having a controller that utilizes the same function keys for three modes of operation.

It is another object of the present invention to provide a hand held control for a vehicle accessory unit that is easy to use.

It is another object of the present invention to provide a hydraulic system including an actuator that is operated with a regenerative fluid loop to increase the speed of the hydraulic system as well as reduce system power consumption.

It is another object of the present invention to provide a hydraulic system including two actuators that are operated with regenerative fluid loops to enable simultaneous but opposite actuator movement.

Other features and advantages of the invention will become apparent to those of ordinary skill in the art upon review of the following detailed description, claims, and drawings.

Figure 1:
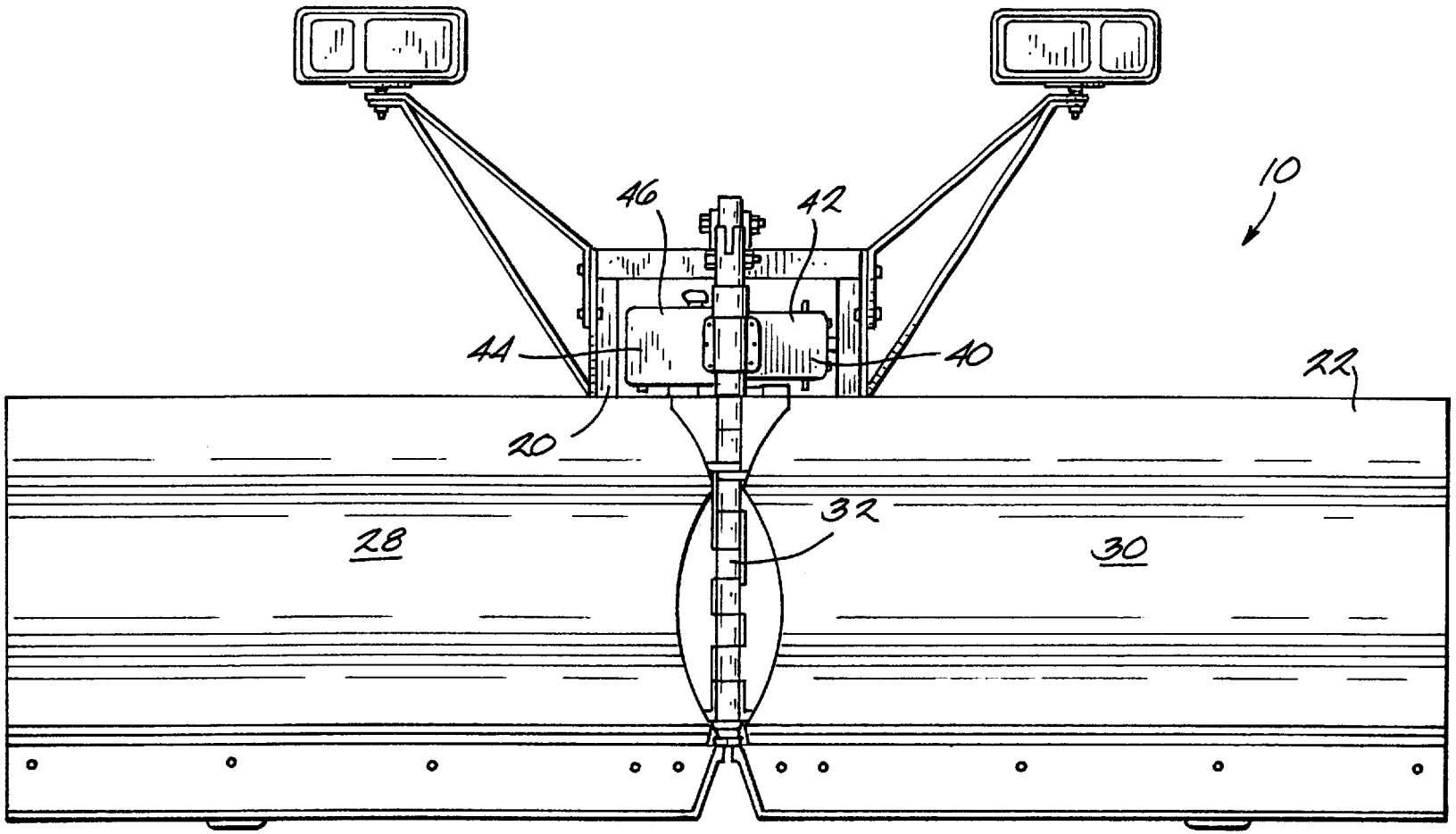
FIG. 1 is a front view of a vehicle accessory unit embodying the invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT

The hydraulic and electrical control systems of the present invention will find particular application in a V-plow accessory unit to control raising, lowering, and angling of the snowplow blade and to control moving of the individual wings of the blade. For that reason, the invention will be described in such an arrangement. However, it should be appreciated that the invention has more general utility and is not specifically limited to any particular vehicle accessory unit.

Figure 2:
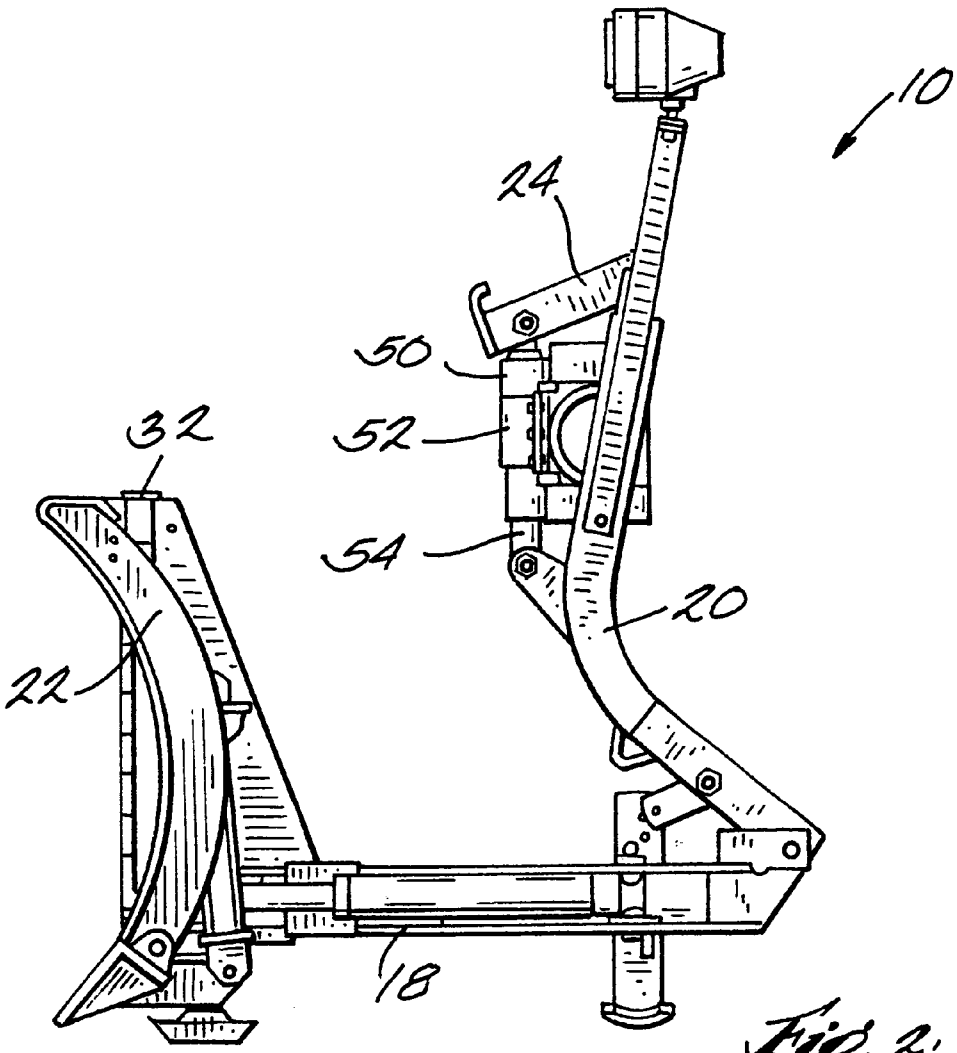
FIG. 2 is a side view of the vehicle accessory unit.
Figure 3:
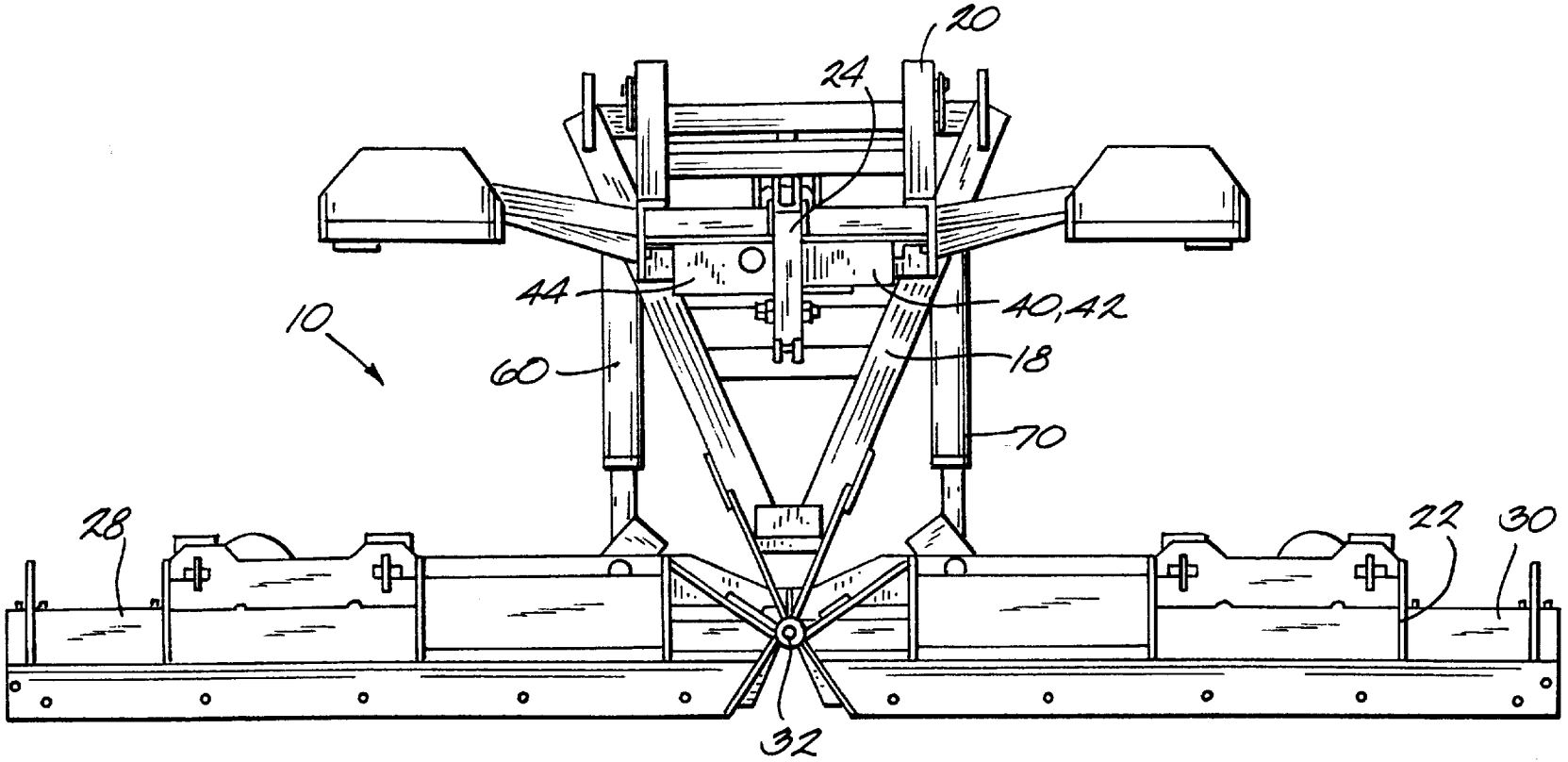
FIG. 3 is a plan view of the vehicle accessory unit.

Referring now to the drawings, there is shown in FIGS. 1 through 3 a vehicle accessory unit, such as snowplow assembly 10, adapted to be removably secured to a vehicle through the use of a mounting frame which is preferably permanently fixed to the vehicle. The snowplow assembly 10 includes an A-frame 18, a lift frame 20 and a snowplow blade 22. The A-frame 18 is adapted to be removably attached to a mounting frame.

The lift frame 20 is pivotally connected to the A-frame 18 and is adapted to be releasably connectable to a mounting frame. The lift frame 20 includes a lift arm 24. A chain connector (not shown) extends between the lift arm 24 and the A-frame 18. The blade 22 is secured to the A-frame 18. The snowplow assembly 10 is connectable to and releasable from the vehicle as described in U.S. patent application Ser. No. 08/566,277 filed on Dec. 1, 1995 which is incorporated herein by reference.

The blade 22 is preferably of the V-blade type. The blade includes a first right wing 28, a second left wing 30 and a pivot mechanism 32 such as a hinge therebetween. As will be described in more detail below, the blade 22 is operable similar to the operation of a straight blade, is operable in vee and scoop orientations, and is operable such that each wing 28 and 30 is individually movable in a first direction such as forwardly or away from the vehicle and a second direction such as rearwardly or toward the vehicle.

The hydraulic system 38 of the present invention includes a power unit 40 that is supported by the lift frame 20. The power unit 40 includes a motor 42 which is preferably a conventional electric motor operated from the vehicle battery such as model #66369 from Wapsa Auto, a division of Robert Bosch, of Sao Paulo, Brazil. A pump 44 is operatively connected to the motor 42 or other supply source and in fluid communication with a reservoir 46. The pump 44 pumps hydraulic fluid from the reservoir 46 through various conduits and solenoid valves to hydraulic actuators which will be detailed hereinafter. Preferably, the pump 44 is of the fixed displacement spur gear pump type such as model S202L-4433 from MTE Hydraulics Inc. of Rockford, Ill. The power unit 40 is electrically powered by connection of the power unit 40 to the vehicle's electrical system as will be described in conjunction with the electrical control system.

Figure 4:
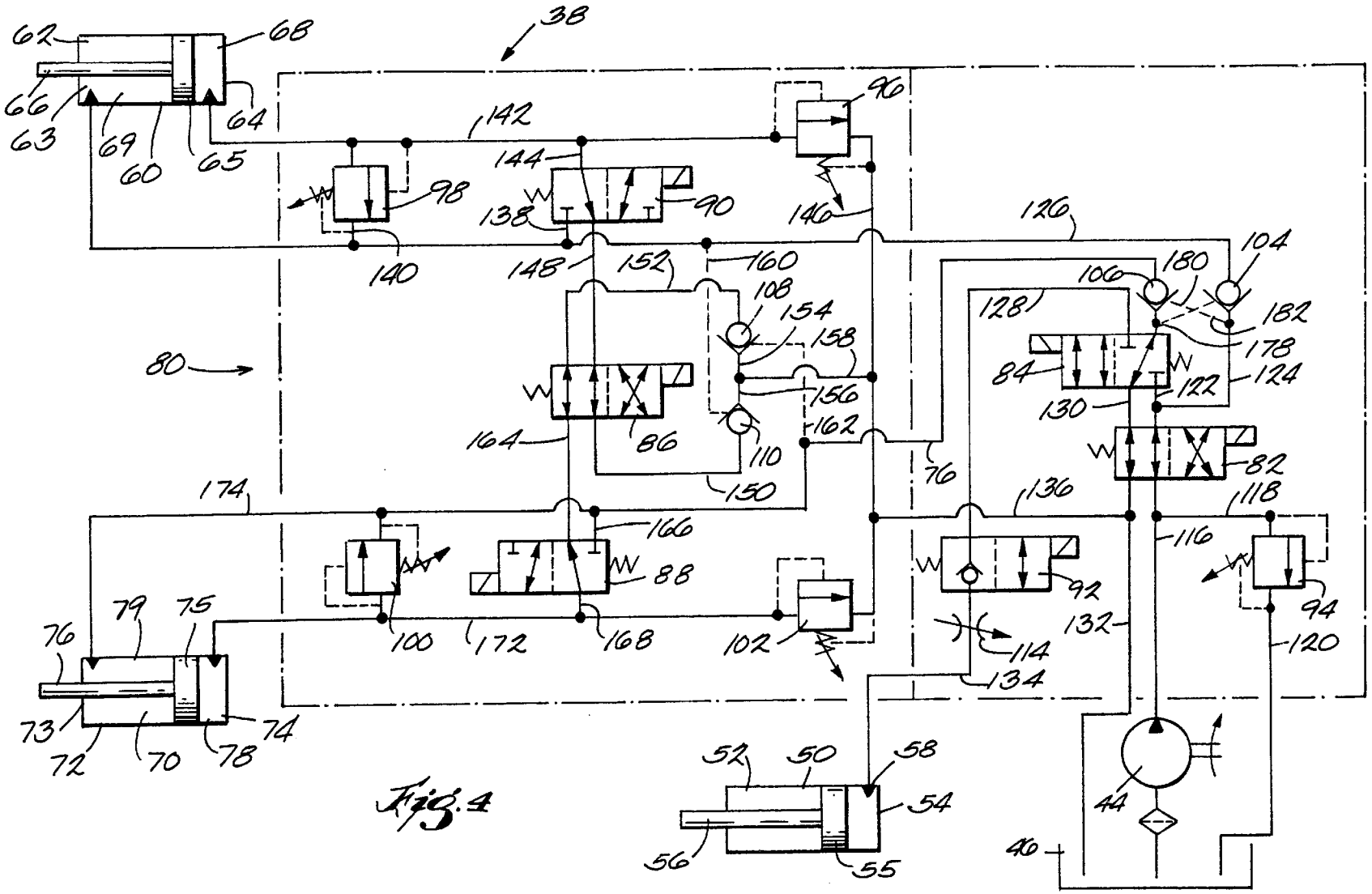
FIG. 4 is a schematic of a hydraulic system.

A first or lift hydraulic actuator 50 is in communication with the power unit 40. Preferably, the actuator 50 is a conventional single acting hydraulic cylinder such as model #66650 available from Western Products of Milwaukee, Wis. and Fisher Engineering of Rockland, Me. The actuator 50 includes a housing 52 having a base end 54 that is pivotally supported by the lift frame 20. As best shown in FIG. 4, a piston 55 and a piston rod 56 secured to the piston 55 reciprocally move within the housing 52. A base side 58 of the actuator 50 is defined as the area in the housing 52 between the base end 54 and the piston 55. The rod 56 is pivotally connected to the lift arm 24 so that movement of the rod 56 away from the base end 54 rotates and raises the lift arm 24 and in turn causes rotation or lifting of the A-frame 18 and blade 22 via the chain connection. To lower the blade 22, the rod 56 is retracted toward the base end 54 of the housing 52.

The hydraulic system further includes a first angle hydraulic actuator 60 positioned between the A-frame 18 and the right a first wing 28 of the blade 22. Preferably, the actuator 60 is a conventional double acting hydraulic cylinder such as model #66534 available from Western Products of Milwaukee, Wis. and Fisher Engineering of Rockland, Me. As best shown in FIG. 4, the actuator 60 includes a housing 62 having a rod end 63 and a base end 64 that is connected to the A-frame 18. A piston 65 and a piston rod 66 secured to the piston 65 reciprocally move within the housing 62. A base side 68 of the actuator 60 is defined as the area in the housing 62 between the base end 64 and the piston 65. A rod side 69 of the actuator 60 is defined as the area in the housing 62 between the rod end 63 and the piston 65. Movement of the piston 65 away from the base end 64 causes the right wing 28 of the blade 22 to move in a forward direction or in other words extends the wing 28. Movement of the piston 65 toward the base end 64 causes the right wing 28 to move in a rearward direction or in other words retracts the wing 28.

A second angle hydraulic actuator 70 is positioned between the A-frame 18 and the second or left wing 30 of the blade 22. Preferably, the actuator 70 is a conventional double acting hydraulic cylinder such as model #66534 available from Western Products of Milwaukee, Wis. and Fisher Engineering of Rockland, Me. As best shown in FIG. 4, the actuator 70 includes a housing 72 having a rod end 73 and a base end 74 that is connected to the A-frame 18. A piston 75 and a piston rod 76 secured to the piston 75 reciprocally move within the housing 72. A base side 78 of the actuator 70 is defined as the area in the housing 72 between the base end 74 and the piston 75.

A rod side 79 of the actuator 70 is defined as the area in the housing 72 between the rod end 73 and the piston 75. Movement of the piston 75 away from the base end 78 causes the left wing 30 of the blade 22 to move in a forward direction or in other words extends the wing 30. Movement of the piston 75 toward the base end 74 causes the left wing 30 to move in a rearward direction or in other words retracts the wing 30.

As illustrated in FIG. 4, the hydraulic system 38 includes a circuit 80 between the reservoir 46 and pump 44 and the three hydraulic actuators 50, 60 and 70. The circuit 80 includes various valves and conduits as are detailed below. The hydraulic circuit is an example of the means for supplying hydraulic fluid to the first actuator and the second actuator in various modes of operation.

The hydraulic circuit 80 includes four way hydraulic solenoid cartridge valves 82 and 86 such as model #Sv08-40-0-N-00 and four way hydraulic solenoid cartridge valve 84 such as model #SV-08-43-0-N-00, all from Hydra-Force, Inc. of Lincolnshire, Ill.; three way hydraulic solenoid cartridge valves 88 and 90 such as model #SV-00-30-0-N-00 from Hydra-Force, Inc. of Lincolnshire, Ill.; two way hydraulic solenoid cartridge valve 92 such as model #SV-08-2004-0-N-00 from Hydra-Force, Inc. of Lincolnshire, Ill.;

pressure relief valves 94, 96, 98, 100 and 102 such as model #49138 from Western Products of Milwaukee, Wis.; pilot-operated check valves 104, 106, 108 and 110 such as model #21392 from Western Products of Milwaukee, Wis. and Fisher Engineering of Rockland, Me.; and restrictor valve 114 such as model #66509 from Western Products of Milwaukee, Wis. and Fisher Engineering of Rockland, Me.; as well as the various numbered conduits 116-182. It should be noted that the various solenoid valves are shown in their non-energized positions in FIG. 4. Where noted, various valves are energized move to their second or energized positions which is not shown in FIG. 4.

Preferably, the various valves of the hydraulic circuit are housed in a manifold block with the manifold block being mounted to a lift cylinder or directly to the detachable frame. Further, the conduits are preferably hydraulic fluid hoses or machined parts fabricated of rubber with ware braiding or aluminum, respectively.

In a first or straight blade mode of operation, the hydraulic system 38 operates the right wing 28 and the left wing 30 of the blade 22 in a straight blade orientation similar to conventional straight blade snowplow accessory units. In this first mode, the blade 22 as a unit can either be angled to the right, angled to the left, raised or lowered.

Preferably in the first mode, the blade 22 is angled to the right or to the left or raised or lowered in its current orientation. For example, if the wings 28 and 30 are in a planar or near planar position, the blade 22 as a unit will angle right or left or be raised or lowered in the first mode. If it is desired to angle the blade 22 to the right or left in a straight orientation, that is having the right wing 28 and the left wing 30 being approximately in-line or planar, the operator must actuate the individual wings 28 and 30 in the second and/or third mode of operation (as will be described below) to align the wings 28 and 30 to a straight orientation. Optionally, a sensor could be employed to notify the operator when the wings 28 and 30 are in a straight or planar orientation.

In the first mode of operation to raise the blade 22, a raise or first circuit is established wherein a fluid path to the base side 58 of lift hydraulic actuator 50 is established by energizing the motor 42, the pump 44 and first and second selector valves 82 and 84 and not energizing the third selector valve 86, first wing valve 88, and second wing valve 90, and lift valve 92. Pressurized hydraulic fluid flows along conduit 116, through energized valve 82, along conduit 130, through energized valve 84, along conduit 128, through valves 92 and 114 and along conduit 134 to the base side 58 of actuator 50. Movement of the actuator 50 to an extended position raises the blade 22 as previously described.

To lower the entire blade 22, a lower or second circuit is established wherein hydraulic fluid from the base end 58 of actuator 50 is returned to the reservoir 46 by energizing second selector valve 84 and lift valve 92 and not energizing valves 82, 86, 88 and 90. Fluid returns to the reservoir 46 by traveling from the base end 58 of actuator 50 along conduit 134, through valve 114 and energized valve 92, along conduit 128, through energized valve 84, along conduit 130, through valve 82 and along conduit 132 to the reservoir 46.

To angle the blade 22 as a unit to the right in this first mode of operation, an angle right or third circuit is established wherein a hydraulic fluid path to the rod side 69 of actuator 60 is established by energizing the motor 42, the pump 44 and the third selector valve 86 and not energizing valves 82, 84, 88, 90 and 92. Pressurized fluid flows along conduit 116, through valve 82, along conduit 124, through pilot operated (hereafter p.o.) check valve 104, along conduit 126 to the rod side 69 of actuator 60 which moves the piston 65 toward the base side 68 of actuator 60. Fluid in the base side 68 flows along conduits 142 and 144, through valve 90, along conduit 148, through energized valve 86, along conduit 164, through valve 88, and along conduits 168 and 172 to the base side 78 of actuator 70 causing the piston 75 to move toward the rod end 73 of actuator 70.

Fluid from the rod side 79 of actuator 70 is forced to travel a return path to the reservoir 46 along conduits 174 and 176, through unseated check valve 106 (unseated by pressure in pilot conduit 180), along conduit 178, through valve 84, along conduit 130, through valve 82 then along conduit 132 to the reservoir 46.

Movement of the rod 66 of actuator 60 to a retracted position and movement of the rod 76 of the actuator 70 to an extended position causes the blade 22 to move as a whole to an angled right position. This straight blade type movement is accomplished by applying hydraulic fluid to the rod side 69 of actuator 60 thus displacing fluid from the base side 68 of actuator 60 to the base side 78 of actuator 70. This fluid path enables simultaneous but opposite movement of each wing 28 and 30 so that a V-plow blade can be operated as if it were a single straight blade.

To angle the blade to the left in the first mode, an angle left or fourth circuit is established wherein a hydraulic fluid path to the rod side 79 of actuator 70 is established by energizing the motor 42, the pump 44 and the first selector valve 82 and third selector valve 86 and not energizing second selector valves 84, wing valves 88 and 90 and lift valve 92. Pressurized fluid flows along conduit 116, through energized valve 82, along conduit 130, through valve 84 and conduit 178, through p.o. check valve 106, along conduits 176 and 174 to the rod side 79 of actuator 70 which moves the piston 75 toward the base end 74 of actuator 70. Fluid in the base side 78 of actuator 70 flows along conduits 172 and 168, through valve 88, along conduit 164, through energized valve 86, along conduit 148, through valve 90, and along conduits 144 and 142 to the base side 68 of actuator 60 causing the piston 65 to move toward the rod end 63 of actuator 60. Fluid from the rod side 69 of actuator 60 travels a return path to the reservoir 46 along conduit 126, through unseated p.o. check valve 104 (unseated by fluid pressure in pilot conduit 180), along conduits 122 and 124, through energized valve 82, along conduit 132 to the reservoir 46.

Movement of the rod 76 of actuator 70 to a contracted position and movement of the rod 66 of the actuator 60 to an extended position causes the blade 22 to move as a whole to an angled left position. This straight blade type movement is accomplished by applying hydraulic fluid to the rod side 79 of actuator 70 thus displacing fluid from the base side 78 of actuator 70 to the base side 68 of actuator 60. This fluid path enables simultaneous but opposite movement of each wing 28 and 30 so that the V-plow blade can be operated as if it were a single straight blade.

In a second on scoop/vee mode of operation, the hydraulic system 38 operates to move both the right wing 28 and the left wing 30 into either a scoop position with both wings 28 and 30 extended forwardly or a vee position with both wings 28 and 30 retracted.

The second mode also enables both the raising and lowering of the entire blade 22 in its then current orientation. The raising and lowering of the blade 22 in this second mode follows the same circuits as previously described above in the first mode and therefore will not be repeated below.

To actuate the scoop position of the blade 22, a fifth circuit is established wherein a scoop or hydraulic fluid path to the base side 68 and 78 of both actuators 60 and 70 respectively is established by energizing the motor 42, the pump 44 and the selector valve 84 and wing valves 88 and 90 and not energizing first and third selector valves 82 and 86 and lift valve 92. Pressurized fluid flows along conduit 116, through valve 82, along conduit 124, through p.o. check valve 104, along conduits 126 and 138, through energized valve 90, then along conduits 142 and 144 to the base side 68 of actuator 60. Pressurized fluid also flows from valve 82, along conduit 122, through energized valve 84, through conduit 178 and p.o. check valve 106, along conduits 176, 174 and 166, through energized valve 88, along conduit 168, then along conduit 172 to the base side 78 of actuator 70. Movement of the actuators 60 and 70 to an extended position moves the blade 22 into a scoop orientation.

Regenerative loops are also utilized with the fifth circuit. with respect to the right wing 28, pressurized fluid on the rod side 69 of actuator 60 travels in a regenerative loop along conduits 126 and 138 and through energized valve 90 and conduits 144 and 142 to the base side 68 of actuator 60. Fluid is forced to travel in the regenerative path because fluid entering the base side 68 of the actuator 60 will begin to move the piston 65 toward the rod end 63 due to the greater piston surface area on the base side 68.

With respect to left wing 30, pressurized fluid on the rod side 79 of actuator 70 travels in a regenerative loop along conduits 174 and 166 and through energized valve 88 to the base side 78 of actuator 70. Fluid is forced to travel in the regenerative path because fluid entering the base side 78 of the actuator 70 will begin to move the piston 75 to the rod end 73 due to the greater surface area of the piston 75 on the base side 78.

Through use of the regenerative loops in the fifth circuit, fluid is displaced from the rod side 69 and 79 of actuators 60 and 70 respectively to the base side 68 and 78 of actuator 60 and 70 respectively so that the pump 44 only needs to provide fluid for the displaced rod volumes. The regenerative loop therefore provides increased speed and reduced power consumption in the hydraulic system 38.

To actuate the vee position of the blade 22, a vee or sixth circuit is established wherein a hydraulic fluid path to the rod side 69 and 79 of actuators 60 and 70 is established by energizing the motor 42, the pump 44 and the second selector valve 84 and not energizing third selector valve 86, first and second wing valves 88 and 90, and lift valve 92 86, 88, 90 and 92. Pressurized fluid flows along conduit 116, through valve 82, along conduit 124, through p.o. check valve 104, along conduit 126 to the rod side 69 of actuator 60. Simultaneously, fluid flowing through valve 82 travels along conduit 122, through energized valve 84 and conduit 178, through p.o. check valve 106, along conduit 176 then along conduit 174 to the rod side 79 of actuator 70. Movement of the actuators 60 and 70 to their contracted positions moves both the right wing 28 and the left wing 30 to their retracted positions to form the vee orientation of the blade 22.

Return paths for the hydraulic fluid from each actuator 60 and 70 are provided. Fluid flows from the base side 68 of actuator 60 along conduits 142 and 144, through valve 90, along conduit 148, through valve 86, along conduit 150, through unseated p.o. check valve 110 (unseated by pressurized fluid in pilot conduit 160), along conduits 156, 158, 146 and 136 then along conduit 132 to the reservoir 46. Fluid also flows from the base side 78 of actuator 70, along conduits 172 and 168, through valve 88, along conduit 164, through valve 86, along conduit 152, through unseated p.o. check valve 108 (unseated by pressurized fluid in pilot conduit 162), along conduits 154, 158, 146, 136, and 132 then to the reservoir 46 with the fluid returning from the base side 68 of actuator 60.

In a third or wing mode of operation of the hydraulic system 38, the right wing 28 and the left wing 30 of the blade 22 are individually extendable and retractable and the entire blade 22 in its then current orientation can be raised and lowered. The raising and lowering of the blade 22 in the third mode follows the same circuits as previously described above in the first mode and therefore will not be repeated below.

To extend the right wing 28, a right wing extend or seventh circuit is established wherein a hydraulic fluid path to the base side 68 of actuator 60 is established by energizing the motor 42, the pump 44 and the first wing valve 90 and not energizing valves first and second selector valves 82 and 84, third selector valve 86, second wing valve 88 and lift valve 92. Pressurized fluid flows along conduit 116, through valve 82, along conduit 124, through p.o. check valve 104, along conduit 126, along conduit 138, through energized valve 90, along conduits 142 and 144 to the base side 68 of actuator 60. Fluid on the rod side 69 of actuator 60 is forced to travel in a regenerative loop along conduit 126, along conduit 138 and through energized valve 90 to the base side 68 of actuator 60. This regenerative loop displaces fluid from the rod side 69 of the actuator 60 to the base side 68 of the actuator 60 so that the pump 44 only needs to provide fluid for the displaced rod volume. The regenerative loop therefore provides increased speed and reduced power consumption in the hydraulic system 38.

Movement of the actuator 60 to an extended position extends the right wing 28 of the blade 22. It should be noted that with only the valve 90 energized, no pressurized hydraulic fluid flows to the actuator 70.

To retract the right wing 28, a right wing retract or eighth circuit is established wherein a hydraulic fluid path to the rod side 69 of actuator 60 is established by energizing the motor 42 and the pump 44 and not energizing valves first and second selector valves 82 and 84, third selector valve 86, wing valves 88 and 90, and lift valve 90. It should be noted that no valves are energized. Pressurized fluid flows along conduit 116, through valve 82, along conduit 124, through p.o. check valve 104, along conduit 126 to the rod side 69 of the actuator 60. Fluid from the base side 68 returns to the reservoir 46 by travelling along conduits 142 and 144, through valve 90, along conduit 148, through valve 86, along conduit 150, through unseated p.o. check valve 110 (unseated by fluid pressure in pilot conduit 160), along conduits 156, 158, 146 and 136 then along conduit 132 to the reservoir 46.

Movement of the actuator 60 to a contracted position retracts the right wing 28 of the blade 22.

It should be noted that with no valves energized, no pressurized hydraulic fluid flows to actuator 70.

Also in the third mode of operation, to extend the left wing 30, a left wing extend or ninth circuit is established wherein a hydraulic fluid path to the base side 78 of actuator 70 is established by energizing the motor 42, the pump 44 and the valves 82 and 88 and not energizing valves 84, 86, 90 and 92. Pressurized fluid flows along conduit 116, through energized valve 82, along conduit 122, through valve 84, along conduit 178, through p.o. check valve 106, along conduits 176, 174 and 166, through energized valve 88, along conduits 168 and 172 to the base side 78 of actuator 70. Fluid on the rod side 79 is forced to travel in a regenerative loop along conduits 174 and 166 and through energized valve 88 and conduits 168 and 172 to the base side 78 of actuator 70. This regenerative loop displaces fluid from the rod side 79 to the base side 78 of the actuator 70 so that the pump 44 only needs to provide fluid for the displaced rod volume. The regenerative loop therefore provides increased speed and reduced power consumption.

Movement of the actuator 70 to an extended position extends the left wing 30 of the blade 22. It should be noted that with only the valves 82 and 88 energized, no pressurized hydraulic fluid flows to actuator 60.

To retract the left wing 30, a left wing retract or tenth circuit is established wherein a hydraulic fluid path to the rod side 79 of actuator 70 is established by energizing the motor 42, the pump 44 and the valve 82 and not energizing valves second selectro valve 84, third selector valve 86, first and second wing valves 88 and 90 and lift valve 92. Pressurized fluid flows along conduit 116, through energized valve 82, along conduit 130, through valve 84, along conduit 178, through p.o. check valve 106, along conduits 176 and 174 to the rod side 79 of the actuator 70. A return path to the reservoir 46 is established by fluid flow from the base side 78 of actuator 70 along conduits 172 and 168, through valve 88, along conduit 164, through valve 86, along conduit 152, through unseated p.o. check valve 108 (unseated by pressurized fluid in pilot conduit 162), along conduits 154, 158, 146 and 136, then along conduit 132 to the reservoir 46.

Movement of the actuator 70 to a contracted position retracts the left wing 30 of the blade 22. It should be noted that with only the valve 82 energized, no pressurized hydraulic fluid flows to actuator 60.

For safety purposes, the hydraulic circuit 80 contains the pressure relief valves 94, 96, 98, 100 and 102. Valve 94 is in communication with conduit 116 via conduit 118. In its normal position, valve 94 does not allow communication between conduit 118 and conduit 120. If the hydraulic fluid pressure in conduit 116 exceeds the pressure rating of valve 94, such as 1750 psi, the fluid pressure actuates the valve 94 against its spring force to enable communication between conduit 118 and conduit 120 to thus relieve the fluid pressure in conduit 116. Fluid in conduit 120 returns to the reservoir 46.

Valves 96 and 98 are communication with conduit 142. In their normal positions, valves 96 and 98 do not allow communication between conduits 146 and 126, respectively. If the hydraulic fluid pressure in conduit 144 exceeds the pressure rating of valve 98, such as 2500 psi, the fluid pressure actuates the valve 98 against its spring force to enable communication between conduit 142 and conduit 126 thus relieving pressure in conduit 142. Also, a portion of the volume of the base end 68 of actuator 60 equal to the fluid volume of rod end 69 of actuator 60 will be displaced. As fluid pressure increases in conduit 142, such as 3000 psi, the fluid pressure actuates valve 96 against its spring force to enable communication between conduit 142 and 146, thus relieving the fluid pressure in conduit 142 and the remainder of the fluid volume in base end 68 of actuator 60 through conduits 146, 136 and 132 to the reservoir 146.

Valves 102 and 100 are in communication with conduit 172. In their normal positions, valves 102 and 100 do not allow communication between conduits 146 and 174, respectively. If the hydraulic fluid pressure in conduit 172 exceeds the pressure rating of valve 100, such as 2500 psi, the fluid pressure actuates the valve 100 against its spring force to enable communication between conduit 172 and conduit 174 thus relieving pressure in conduit 172. Also, a portion of the volume of the base end 78 of actuator 70 equal to the fluid volume of rod end 79 of actuator 70 will be displaced. As fluid pressure increases in conduit 172, such as 3000 psi, the fluid pressure actuates valve 102 against its spring force to enable communication between conduits 172 and 146, thus relieving the fluid pressure in conduit 172 and the remainder of the fluid volume in base end 78 of actuator 70 through conduits 146, 136 and 132 to the reservoir 46.

The restrictor valve 114 meters or limits flow between conduits 128 and 134 therefore controlling lift or lower speed.

When the blade 22 has been positioned as desired, the hydraulic circuit 80 assumes a hold position wherein hydraulic fluid in the actuators 60 and 70 cannot be displaced from its current containment thereby holding the actuators in their respective positions and therefore holding the blade 22 in its current position unless the pressure in conduits 142 and 172 exceed the pressure setting of valves 98 and 96 or valves 102 and 100, respectively as described above.

In the hold position of the hydraulic circuit 80, the solenoid valves 82, 84, 86, 88 and 90 are in their non-energized positions. Fluid from the base side 68 of actuator 60 cannot travel back to the reservoir 46 because the path along conduits 142 and 144, through valve 90, along conduit 148, through valve 86 and along conduit 150 is blocked by seated p.o. check valve 110. Similarly, hydraulic fluid from the base side 78 of actuator 70 cannot travel back to the reservoir 46 because the path along conduits 172 and 168, through valve 88, along conduit 164, through valve 86 and along conduit 152 is blocked by seated p.o. check valve 108.

Likewise, hydraulic fluid from the rod side 69 of actuator 60 cannot travel back to the reservoir 46 because the path along conduit 126 is blocked by seated p.o. check valve 104. Fluid from the rod side 79 of actuator 70 also cannot travel back to the reservoir 46 because the path along conduits 174 and 176 is blocked by seated p.o. check valve 106.

In conjunction with the hydraulic system 38, an electrical system 200 is used as an interface between the operator and the hydraulic system 38 to enable operation of the blade 22 as desired. The hydraulic system 38 and the electrical system 200 are a controller of the movement of the blade 22. The electrical system 200 is a means to operate the hydraulic circuit in various modes. The electrical system 200 includes a keypad assembly 202 as well as an electrical harness 204 that is in communication with the vehicle's electrical system and in communication with the hydraulic system 38.

Figure 5:
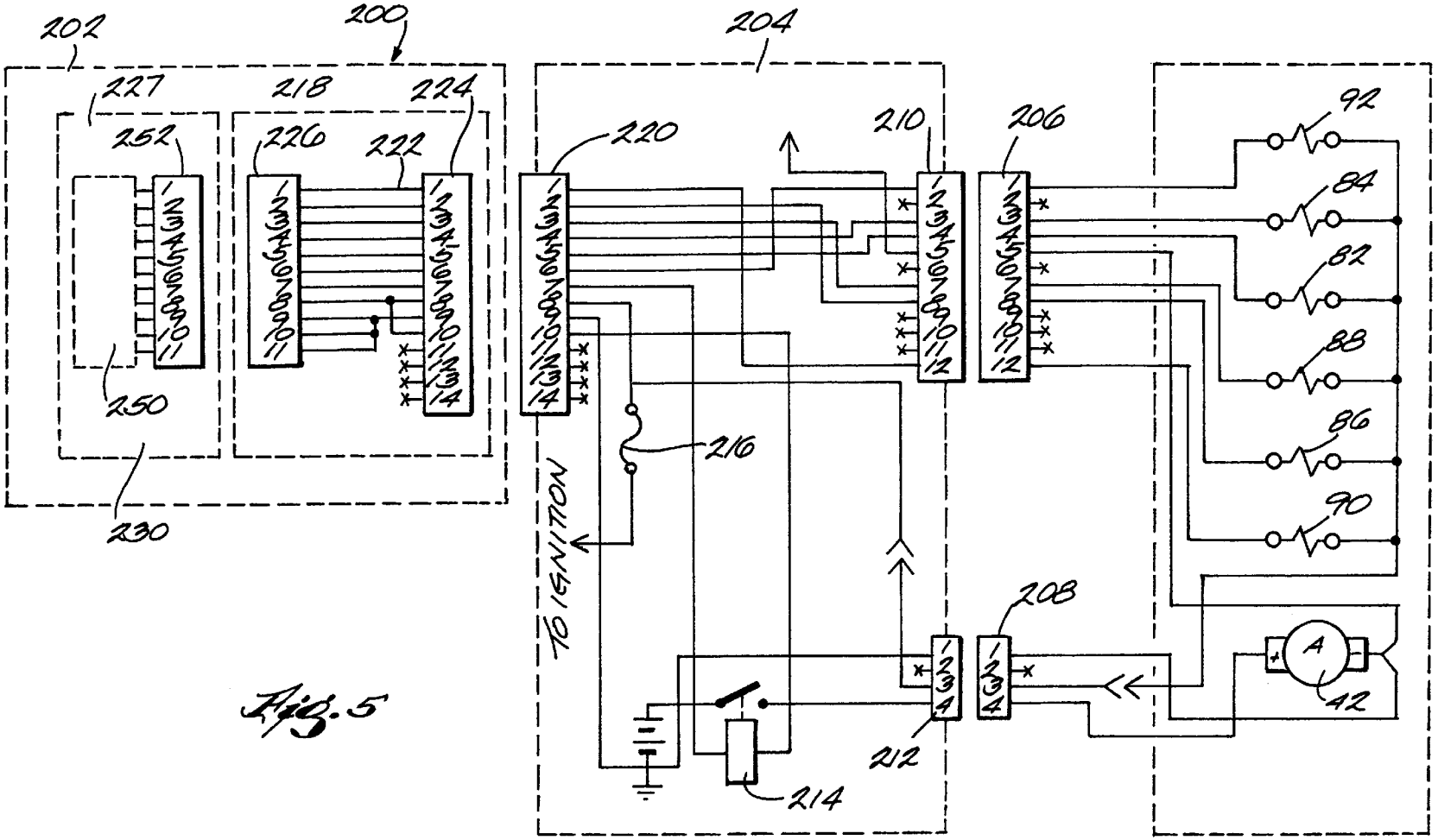
FIG. 5 is a schematic of an electrical system.

Specifically, with reference to FIG. 5, the electrical system 200 is illustrated. It should be noted that the accessory unit light system can also be incorporated into the electrical system as shown in FIG. 5. However, for simplicity, FIG. 5 does not include the light circuits. An electrical coupling 206 such as a twelve pin male connector is in communication with the solenoid valves 82, 84, 86, 88, 90 and 92. Pin 1 of coupling 206 is in electrical communication with solenoid valve 92, pin 3 is in electrical communication with solenoid valve 84, pin 4 is in electrical communication with solenoid valve 82, pin 7 is in electrical communication with solenoid valve 88, pin 8 is in electrical communication with solenoid valve 86 and pin 12 is in electrical communication with solenoid valve 90. The remaining pins of the coupling 206 can be utilized for other purposes such as lighting circuit connections and will therefore not be described herein.

Each solenoid valve 82, 84, 86, 88, 90 and 92 is in electrical communication with pin 3 of a second electrical coupling 208. The second electrical coupling 208 is preferably a four pin male connector. Pin 4 is in electrical communication with the positive terminal of the motor 42 and pin 1 is in electrical communication with the negative terminal of the motor 42. Pin 2 is unused or can be used for other purposes.

Continuing to refer to FIG. 5, the harness 204 includes an electrical coupling 210 preferably located at the grill of the vehicle. The coupling 210 is preferably a twelve receptacle female connector which is adapted to mate and communicate with the twelve pin coupling 206. A second electrical coupling 212 is also preferably located at the grill of the vehicle. The coupling 212 is preferably a four receptacle female connector that is adapted to mate and communicate with the four pin male coupling 208. The harness 204 further includes a motor relay 214, a fuse 216 and a third electrical coupling 220. Preferably, the coupling 220 is a fourteen receptacle female connector that is accessible under the dashboard of the vehicle. one coil terminal of the motor relay 214 is in electrical communication with pin 7 of the coupling 220. The other coil terminal of the motor relay 214 is in electrical communication with pin 10 of the coupling 220. One normally open contact terminal of the motor relay 214 is in electrical communication with the vehicle battery positive terminal. The other normally open contact terminal of the motor relay 214 is in electrical communication with pin 4 of the coupling 212. One terminal of the fuse 216 is in electrical communication with the vehicle ignition circuit. The other terminal of the fuse 216 is in electrical communication with both pin 8 of coupling 220 and pin 3 of coupling 212.

Receptacles 1, 3, 4, 7, 8 and 12 of the coupling 210 are in electrical communication with the respective receptacles 6, 4, 5, 3, 2 and 1 of the coupling 220. Receptacles 2, 5, 6, 9, 10 and 11 of coupling 210 are utilized for other purposes such as the lighting circuit and will therefore not be described herein.

With respect to the remaining receptacles of the coupling 220, receptacle 9 is in electrical communication with ground. Receptacles 11, 12, 13 and 14 are either unused or utilized for other purposes.

With respect to coupling 212, receptacle 1 is in electrical communication with ground, and receptacle 2 is unused or used for other purposes.

Continuing to refer to FIG. 5, the keypad assembly 202 includes an electrical connector cable assembly 218. The cable assembly includes a coil cord 222, a coupling 224 and a coupling 226. The cable assembly 218 allows the operator more flexibility in operating the keypad assembly 202 and reduces the strain to the operator. The coupling 224 is preferably a fourteen pin male coupling 224 that is adapted to mate and communicate with the coupling 220. The coupling 226 is preferably an eleven pin female coupling. Pins 1, 2, 3, 4, 5, 6 and 7 of the coupling 226 electrically communicate with respective pins 1, 2, 3, 4, 5, 6 and 7 of the coupling 224. Pin 8 of the coupling 226 electrically communicates with pins 8 and 10 of the coupling 224. Pins 9, 10 and 11 of the coupling 226 electrically communicate with pin 9 of the coupling 224. Pins 11, 12, 13 and 14 of the coupling 224 are unused or used for other purposes.

Figure 6:
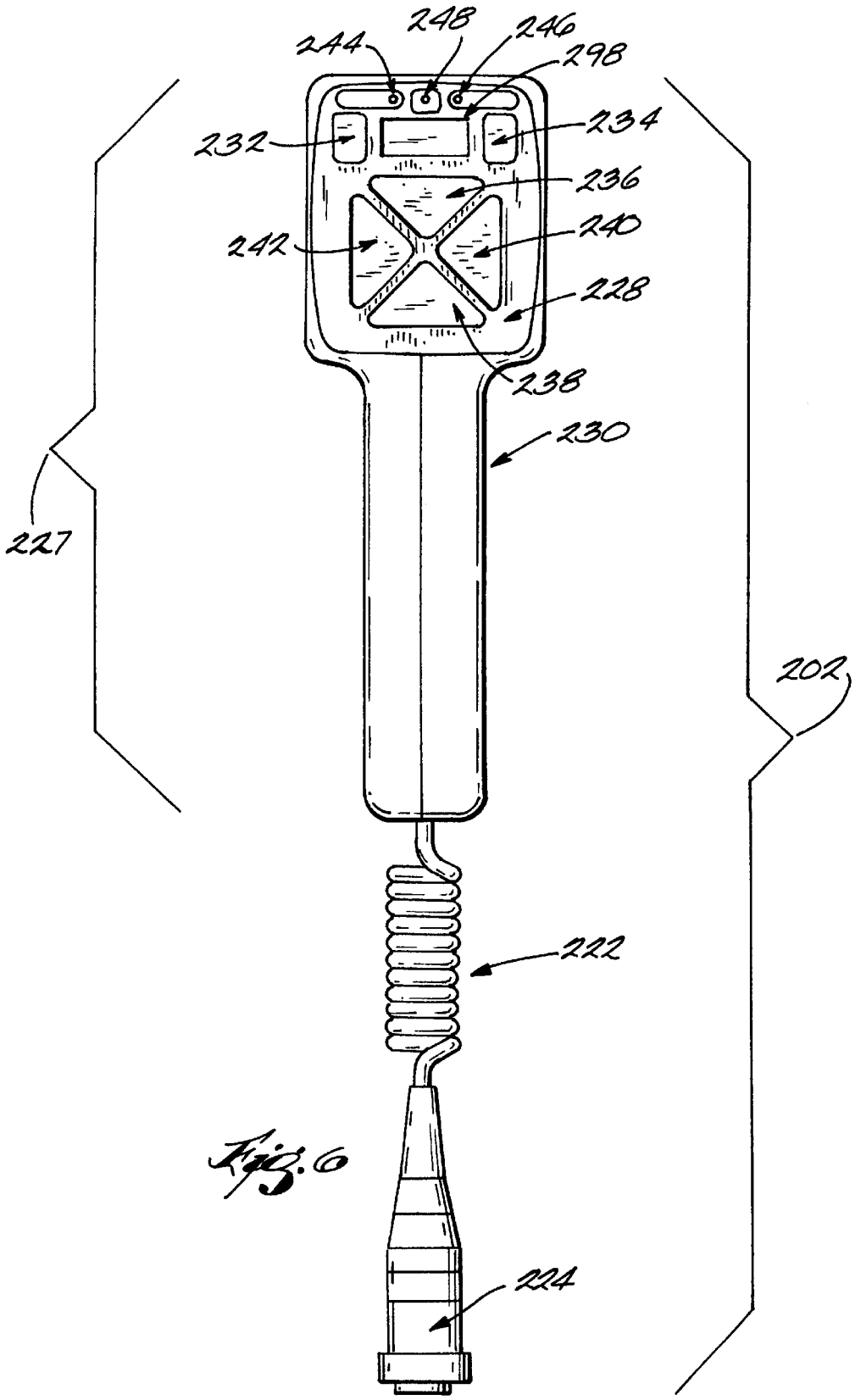
FIG. 6 is a plan view of a keypad of the electrical system.

Referring now to both FIGS. 5 and 6, the keypad assembly 202 further includes a hand held keypad 227 with soft touch controls 228 thereon. The keypad 227 includes a housing 230 that is ergonomically shaped in that it is comfortable for an operator to hold. The soft touch controls 228 provide an ambidextrous feel with one finger operation which is especially important in low light conditions.

On the front face of the keypad 227 are six keys; two that are generally rectangular and four that are generally triangular. The two rectangular keys include the mode key 232 and the power key 234. The four triangular keys and are function keys and are arranged in a square configuration with a first, top key 236 corresponding to the function raise blade, a second bottom key 238 corresponding to the function lower blade, a third, right key 240 corresponding to the functions right movement and vee orientation, and a fourth left key 242 corresponding to the functions left movement and scoop orientation. The keypad 227 also includes a lightable element 244 that corresponds to the mode function, a lightable element 246 that corresponds to the power function and a lightable element 248 that corresponds to the float function. The lightable elements 244, 246 and 248 are preferably LEDs.

As shown in FIG. 5, the keypad 227 also includes a programmed microcontroller 250 such as model #PIC 16C55-RC/S0 from Microchip Technology Inc. of Chandler, Az. The microcontroller 250 is conventionally programmed with the various blade and operational functions as will be explained below. The microcontroller 250 is surface mounted on a pc board within the housing 230. The pc board is in communication with an electrical coupling 252 in the housing 230. The coupling 252 enables communication with the coupling 226. Preferably, the coupling 252 is an eleven receptacle male connector that mates and communicates with the eleven pin female coupling 226 of the cable assembly 218. Receptacles 1-11 of the coupling 252 are in electrical communication with the microcontroller 250 via the pc board. Receptacles 1-11 of the coupling 252 are in electrical communication with pins 1-11 respectively of the coupling 226. Receptacles 1-6 of the coupling 252 ultimately control the energizing and de-energizing of the solenoid valves 82, 84, 86, 88, 90 and 92, receptacle 7 electrically communicates with the motor relay and receptacles 9-11 electrically communicate with ground.

When the snowplow assembly 10 is attached to the vehicle, the couplings 206 and 208 on the snowplow assembly 10 and the respective couplings 210 and 212 at the grill of the vehicle are matingly engaged. The coupling 224 of the cable assembly 218 is matingly engaged with the coupling 220 located in the vehicle. The coupling 226 of the cable assembly 218 is matingly engaged with the coupling 252 in the housing 230 of the keypad 227. The keypad assembly 202 enables the operator to operate the blade 22 from within the vehicle and provides the flexibility of being able to hold the keypad 227 comfortably. With the above connections made, the electrical system 200, the hydraulic system 38 and the snowplow assembly operate as follows. When the vehicle is not running, the keypad assembly 202 is inoperable due to the connection of the harness to the vehicle ignition system.

With the vehicle running, the keypad assembly 202 is operable by depressing the power key 234. It should be noted that when the vehicle is running, the housing 230 of the keypad 227 is preferably is illuminated allowing an operator to easily locate the keypad assembly 202 in low light conditions. The electrical system 200 and the hydraulic system 38 will then be energized through the various connections to the vehicle battery. When the electrical and hydraulic systems are powered, the lightable element 246 on the keypad 227 is illuminated to so indicate.

When power is activated, the microcontroller 250 is programmed such that the hydraulic system 38 is powered up in the first mode (straight blade) regardless of which of the three modes was last operable when power was deactivated. To indicate that the hydraulic system 38 is in the first mode, the lightable element 244 is not illuminated. To activate the second mode of the hydraulic system 38 (scoop/vee), the mode key 232 is depressed and released quickly and the lightable element 244 will light. To activate the third mode of the hydraulic system 38 (wing), the mode key 232 is depressed and held for two seconds then released. The lightable element 244 will flash indicating that the hydraulic system 38 is in the third mode.

When the keypad assembly 202 is activated to be in the first mode (straight blade), the microcontroller 250 is preprogrammed to send appropriate signals to the hydraulic system 38 to perform the following functions. When the top or first function key 236 is depressed, the microcontroller 250 activates the motor 42, the pump 44 and the solenoid valves 82 and 84 to establish the first circuit and the blade 22, in whatever orientation it is currently in, is raised until the top key 236 is no longer depressed or until the function times out, as will be explained below. Raising the blade 22 cancels the float function, as is described below, and the lightable element 248 will be deactivated so as to be not illuminated.

The float function of the blade 22 provides the ability for the blade 22 to follow the contour of the surface being plowed by energizing the solenoid valves 84 and 92.

When the bottom or second function key 238 is depressed in the first mode of operation, the microcontroller 250 activates the valves 84 and 92 to establish the second circuit and the blade 22, in whatever orientation it is currently in, is lowered until the bottom key 238 is no longer depressed. The microcontroller 250 is preprogrammed such that the blade 22 will go into float mode after a set period of time such as 0.75 seconds and the lightable element 248 will be illuminated.

When the right or third function key 240 is depressed in the first mode, the microcontroller 250 activates the motor 42, the pump 44 and the solenoid valve 86 to establish the third circuit and the blade 22 is angled to the right until the right key 240 is no longer depressed or until the function times out as is explained below. When the left or fourth function key 242 is depressed, the microcontroller 250 activates the motor 42, the pump 44 and the solenoid valves 82 and 86 to establish the fourth circuit and the blade 22 is angled to the left until the left key 242 is no longer depressed or until the function times out as will be explained below.

When the keypad is activated to be in the second mode (scoop/vee) of operation by quick depression of the mode key 232, the microcontroller 250 is pre-programmed to send appropriate signals to the hydraulic system 38 to perform the following functions. When the top key 236 or bottom key 238 are depressed, the blade 22 is respectively raised or lowered in its present orientation as discussed above with respect to the first mode.

In the second mode, if the left key 242 is depressed by the operator, the microcontroller 250 activates the motor 42, the pump 44 and the solenoid valves 84, 88 and 90 to establish the fifth circuit and the blade 22 is moved into a scoop orientation. If the right key 240 is depressed by the operator, the microcontroller 250 activates the motor 42, the pump 44 and the solenoid valve 84 to establish the sixth circuit and the blade 22 is moved into a vee orientation.

When the keypad 227 is activated to be in the third mode (wing) of operation by extended depression of the mode key 232, the microcontroller 250 is preprogrammed to send appropriate signals to the hydraulic system 38 to perform the following functions. When the top key 236 or bottom key 238 are depressed, the blade 22 is respectively raised or lowered in its present orientation as discussed above with respect to the first mode.

In the third mode, if the right key 240 is depressed by the operator, the microcontroller 250 activates the motor 42, the pump 44 and none of the solenoid valves to establish the eight circuit and the right wing 28 begins to retract. The next depression of the right key 240 toggles the hydraulic circuit 38 and the microcontroller 250 is pre-programmed to establish the seventh circuit and the right wing 28 begins to extend forwardly. Accordingly, each time the right key 240 is depressed and released, the microcontroller 250 toggles between communicating with the hydraulic circuit 38 to extend and retract the right wing 28.

Similarly, if the left key 242 is depressed by the operator, the microcontroller 250 activates the motor 42, the pump 44 and the solenoid valve 82 establishing the tenth circuit and the left wing 30 begins to retract. The next press of the left key 242 toggles the hydraulic circuit 38 and the microcontroller 250 is preprogrammed to establish the ninth circuit and the left wing 30 begins to extend. Accordingly, each time the left key 242 is depressed and released, the microcontroller 250 toggles between communicating with the hydraulic circuit 38 to extend and retract the left wing 30.

In any of the three modes of operation, after the operator releases the respective key on the keypad 227, the microcontroller 250 sends signals to deenergize the solenoid valves to activate the hold circuit previously discussed so that the blade 22 maintains its current orientation.

In addition to the above functions, the microcontroller 250 is pre-programmed with time outs such that, with all of the functions with the exception of lowering the blade 22, after a predetermined period of time, the function automatically stops or times out. Preferably, the raise function times out after 2.5 seconds and the remainder of the functions time out after 4.25 seconds. The timing out function reduces unnecessary electrical system power consumption. For example, the time out function prolongs battery charge when an operator is backing up the vehicle and depressing a key for a long period of time.

The microcontroller 250 is also preprogrammed with a soft stop function. The soft stop function automatically allows the wings 28 and 30 of the blade 22 to coast to a stop after being moved. The soft stop function results in a smoother operator "feel" to controlling blade movement and further reduces the shock to the hydraulic system 38 of abrupt stops resulting in longer life to the hydraulic system 38. The soft stop function is accomplished by preprogramming the microcontroller 250 to allows the solenoid valves 82, 84, 86, 88 and 90 to be held "on" a short duration as the pump motor inertia winds down. Preferably, the short duration is one second. This reduces the pressure spikes on the pressure relief valves 94, 96, 98, 100 and 102.

The microcontroller 250 is further preprogrammed with the safety feature of preventing inadvertent operation of the hydraulic system 38 in the event of a system failure. To accomplish this function, the program periodically resets a timer internal to the microcontroller 250. Should the program fail to reset the this timer, the internal circuitry would reset the microcontroller and all outputs would safely turn off.

The microcontroller 250 is further preprogrammed with a safety feature of powering down the system after a predetermined period of non-use such as 20 minutes. The power down function provides safety for road transport of the snowplow assembly 10. The power down function is accomplished through the program the microcontroller executes.

We claim:

1. A hydraulic system for selectively moving the first and second wings of a V-plow snowplow blade, said system comprising:

a first double acting angle hydraulic actuator in engagement with the first wing for selectively moving the first wing, said first actuator having a base side and a rod side;

a second double acting angle hydraulic actuator in engagement with the second wing for selectively moving the second wing, said second actuator having a base side and a rod side;

a pump;

a hydraulic fluid reservoir in communication with said pump;

a first valve having a first position such that said reservoir through said pump is in fluid communication with said rod side of said first angle actuator and a second position such that said reservoir through said pump is in fluid communication with said base side of said first angle actuator;

a second wing valve having a first position such that said reservoir through said pump is in fluid communication with said rod side of said second angle actuator and a second position such that said reservoir through said pump is in fluid communication with said base side of said second actuator; and a third valve having a second position such that said base sides of said first and second angle actuators are in fluid communication and a first position such that said base side of said first and second angle actuators are obstructed from fluid communication.

2. A hydraulic and electrical control system for a V-plow blade having a first wing and second wing, said system comprising:

a hydraulic circuit comprising a first hydraulic angle actuator adapted to be in operational engagement with the first wing;

a second hydraulic angle actuator adapted to be in operational engagement with the second wing;

a hydraulic pump; and a hydraulic fluid reservoir in communication with said pump;

means to operate said hydraulic circuit in a first mode whereby said first angle actuator is actuated to move the first wing in a first direction while said second angle actuator is actuated to simultaneously move the second wing in a second direction opposite to the first direction;

means to operate said hydraulic circuit in a second mode whereby said first angle actuator is actuated to move the first wing in a first direction simultaneously as said second actuator is actuated to move the second wing in the first direction; and means to operate said hydraulic circuit in a third mode whereby the first angle actuator is actuated to move the first wing independent of the movement of the second wing and whereby the second angle actuator is actuated to move said second wing independent of the movement of said first wing.

3. A hydraulic and electrical control system for a V-plow blade having mounted snowplow having a first wing and a second wing, said system comprising:

a hydraulic circuit comprising a first hydraulic angle actuator adapted to engage the first wing;

a second hydraulic angle actuator adapted to engage the second wing;

a hydraulic pump; and a hydraulic reservoir in communication with said pump;

a keypad having a mode key and a function key;

said mode key having first, second and third modes of operation, a controller in communication with said pump, said first and second hydraulic angle actuators and said keypad, said controller including means to operate said hydraulic circuit in a first mode of operation whereby when said mode key is in said first mode of operation and said function key is depressed, said first angle actuator is actuated to move the first wing in a first direction while said second angle actuator is actuated to simultaneously move the second wing in a second direction opposite to said first direction and, when said function key is depressed, said second angle actuator is actuated to move the second wing in said first direction while said first angle actuator is actuated to simultaneously move the first wing in said second direction;

means to operate said hydraulic circuit in a second mode of operation whereby when said mode key is depressed and in said second mode of operation and said function key is depressed, said first angle actuator is actuated to move the first wing in said first direction simultaneously as said second angle actuator is actuated to move the second wing in said first direction and, when said second function key is depressed, said first angle actuator is actuated to move the first wing in said second direction simultaneously as said second angle actuator is actuated to move the second wing in said second direction; and means to operate said hydraulic circuit in a third mode of operation whereby when the mode key is depressed and in said third mode of operation and said function key is depressed, said first angle actuator is actuated to move the first wing in one of said first and second directions and, when said second function key is depressed, said second angle actuator is actuated to move the second wing in one of said first and second directions.

4. A hydraulic system for selectively moving the first and second wings of a V-plow snowplow blade, said system comprising:

a first double acting angle hydraulic cylinder connectable to the first wing for selectively moving the first wing, said first hydraulic cylinder having a base side and a rod side;

a second double acting angle hydraulic cylinder connectable to the second wing for selectively moving the second wing, said second hydraulic actuator having a base side and a rod side;

a hydraulic fluid reservoir;

a pump in communication with said reservoir;

hydraulic fluid conduits connecting said first and second hydraulic cylinders to said pump and said reservoir;

a plurality of flow control valves in said hydraulic fluid conduits;

said valves having plural flow control positions to establish selective fluid flow paths to and from said rod and base sides of first and second hydraulic cylinders; and means for operating said valves to establish said fluid flow paths such that the first and second wings are moveable in unison and are moveable one wing independent of the other wing.

5. The hydraulic system of claim 4 wherein said hydraulic fluid conduits and said flow control valves include a first selector valve in communication with said pump;

a second selector valve between said first selector valve and said first hydraulic cylinder;

a first conduit forming a hydraulic fluid flow path from said second selector valve to said rod side of said first hydraulic cylinder;

a second conduit forming a hydraulic fluid flow path from a point between said first and second selector valves to said rod side of said second hydraulic cylinder;

said first and second selector valves having a first operable position selectively establishing hydraulic fluid flow from said pump through said first and second selector valves to said first conduit while simultaneously allowing the hydraulic fluid flow path from said first selector valve to said second conduit;

said first and second selector valves having a second operable position selectively establishing hydraulic fluid flow from said pump through said first selector valves to said second conduit while simultaneously allowing the hydraulic fluid flow path through said second selector valve to said first conduit;

first and second wing valves in communication with said base side of said first and second hydraulic cylinders respectively;

a third selector valve positioned between said first and second wing valves;

said third selector valve and said first and second wing valves having operable positions establishing a hydraulic fluid flow path between said base sides of said first and second hydraulic cylinders; and whereby said system enables the snowplow blade to be selectively angled to the left and the right.

6. The hydraulic system of claim 5 wherein said first and second selector valves having a third operable position establishing simultaneous flow through said first and third conduits;

said first and second wing valves and third selector valve having operable positions establishing a hydraulic fluid flow paths from said base side of said first and second hydraulic cylinders through said first and second wing valves and third selector valve to said reservoir; and whereby said system enables the wings to be operable to establish a V configuration of the snowplow blade.

7. The hydraulic system of claim 5 wherein said first and second wing valves have operable positions connecting said first and second conduits to said repsective base sides of said first and second angle hydraulic cylinders, establishing a hydraulic fluid flow path from said rod side of said first angle hydraulic cylinder to said base side of said first angle hydraulic cylinder, and establishing a hydraulic fluid flow path from said rod side of said second angle hydraulic cylinder to said base side of said second angle hydraulic cylinder; and whereby said system enables the wings to be operable to establish a scoop configuration of the snowplow blade.

8. The hydraulic system of claim 5 wherein when said first and second selector valves are in said first operable position, said first wing valve has a first operable position establishing a hydraulic fluid flow path between said base side of said first angle hydraulic cylinder and said reservoir and said first wing valve has a second operable position establishing a hydraulic fluid flow path between said first conduit and said base side of said first angle hydraulic cylinder and simultaneously establishing a hydraulic fluid flow path between said rod side of said first angle hydraulic cylinder and said base side of said first angle hydraulic cylinder;

when said first and second selector valves are in said second operable position, said second wing valve has a first operable position establishing a hydraulic fluid flow path between said base side of said second angle hydraulic cylinder and said reservoir and said second wing valve has a second operable position establishing a hydraulic fluid flow path between said second conduit and said base side of said second angle hydraulic cylinder and simultaneously establishing a hydraulic fluid flow path between said rod side of said second angle hydraulic cylinder and said base side of said second angle hydraulic cylinder; and whereby said system enables the wings to be moved forwardly and rearwardly and moved independent of each other.

9. The combination of claim 4 where said first and second angle hydraulic cylinders are electrically operated and including a keypad controller, said keypad controller comprising a plurality of blade function keys less in number than the available operating positions of said blade, an electrical interface between said blade function keys and said electrically powered blade moving system, said electrical interface having multiple modes of operation corresponding to the available operating positions of said blade, said mode key connected to said electrical interface and having multiple operating positions and operative, in cooperation with said electrical interface, in each of said positions to select one of said multiple modes of operation of said electrical interface, said mode key in each of its operative positions energizing said blade function keys and said electrical interface to select less than all of the available operating positions of said blade.

10. The combination of claim 9 wherein said wings are moveable individually and independent of each other about said hinge, to angle said wings jointly rigt and left about said hinge, to pivot said wings into a V configuration, and to pivot said wings into a scoop configuration, two of said function keys control the blade moving system to move said wings independent of each other, to angle said blades both right and left, to move said wings into a V configuration, and to move said wings into a scoop configuration.

11. The combination of claim 10 wherein said function keys are operative to activate said hydraulic cylinders to lift and lower said snowplow blade, and said function keys are four in number and two of said function keys in each operative position of mode key controlling the lift lower function of said snowplow blade.

12. The combination of claim 11 wherein said keypad has a longitudinal axis, said function keys are arranged about the longitudinal axis with the two of said function keys controlling the lift and lower functions arranged along the axis and the other two function keys are arranged one on each side of longitudinal axis.

13. The combination of claim 12 wherein said function keys are arranged in general cross pattern and the two function keys controlling the lidt and lower functions are arranged on one leg of the cross with the other two function keys arranged on the other leg of the cross.

14. The combination of claim 13 wherein said function keys are generally triangular in shape and nested together in a generally rectangular pattern.

15. A hydraulic system for selectively moving the first and second wings of a V-plow snowplow blade, said system comprising:

a first double acting angle hydraulic actuator connectable to the first wing for selectively moving the first wing, said first hydraulic actuator having a base side and a rod side;

a second double acting angle hydraulic actuator connectable to the second wing for selectively moving the second wing, said second hydraulic actuator having a base side and a rod side;

a pump;

a hydraulic fluid reservoir in communication with said pump;

a first selector valve in communication with said pump;

a second selector valve;

a first fluid flow connection from said second selector valve to said rod side of said first angle hydraulic actuator;

a third fluid flow connection from said first selector valve to said second selector valve;

a second fluid flow connection between said first selector valve and said rod side of said second angle hydraulic actuator;

a first wing valve;

a fourth fluid flow connection between said first wing valve and said base side of said first angle hydraulic actuator;

a second wing valve;

a fifth fluid flow connection between said second wing valve and said base side of said second hydraulic angle actuator;

a third selector valve;

a sixth fluid flow connection between said third selector valve and said reservoir;

a seventh fluid flow connection between said first wing valve and said third selector valve; and an eighth fluid flow connection between said second wing valve and said third selector valve.

16. The hydraulic system of claim 15 wherein said valves all having a first flow control position, moveable under power from said first position to a second flow control position, and returnable to said first position when said power is removed;

said first and second selector valves both in their first position establishing a hydraulic fluid flow path between said pump and said third connection and interrupting hydraulic fluid flow from said pump to said first connection;

said first selector valve in its second position and said second selector valve in its first position establishing a hydraulic fluid flow path between said pump and said first connection and interrupting hydraulic fluid flow from said pump to said third connection;

said first wing valve in its first position establishing a hydraulic fluid flow path between said fourth connection and said seventh connection;

said second wing valve in its first position establishing a hydraulic fluid flow path between said fifth connection and said eighth connection;

said first wing valve in its second position establishing a hydraulic fluid flow path between said second selector valve and said fourth connection and interrupting the hydraulic fluid flow path between said first connection and said rod side of said first hydraulic actuator;

said second wing valve in its second position establishing a hydraulic fluid flow path between said first selector valve and said fifth connection and interrupting the hydraulic fluid flow path between said third connection and said rod side of said second hydraulic actuator;

said third selector valve in its first position establishing a hydraulic fluid flow path between said seventh connection and said sixth connection and establishing a hydraulic fluid flow path between said eighth connection and said sixth connection; and said third selector valve in its second position establishing a hydraulic fluid flow path between said seventh connection and said eight connection.

17. The hydraulic system of claim 16 further including a controller operative to power said first and third selector valves while second selector valve and first and second wing valve remain in their first positions and operative to power said third selector valve while said first and second selector valves and first and second wing valve remain in their first positions whereby said system enables the snowplow blade to be selectively angled to the left and to the right.

18. The hydraulic system of claim 16 further including a controller operative to power said second selector valve while said first and third selector valves and said first and second wing valves remain in their first positions whereby said system enables the wings to establish a V configuration of the snowplow blade.

19. The hydraulic system of claim 16 further including a controller operative to power said second and third selector valves and first and second wing valves while said first and third selector valves remain in their first positions whereby said system enables the wings to establish a scoop configuration of the snowplow blade.

20. The hydraulic system of claim 16 further including a controller operative to power said second wing valve while said first, second, third selector valves and first wing valve remain in their first positions whereby said system enables the second wing to be moveable independently of the first wing.

21. The hydraulic system of claim 16 further including a controller operative to power said first selector valve and said first wing valve while said second and third selector valves and said second wing valves remain in their first positions and operative to power said first selector valve while said second and third selector valves and said first and second wing valves remain in their first positions whereby said system enables the first wing to be movable independently of the second wing.

22. The hydraulic system of claim 16 further including a keypad controller having movable mode key and first and second moveable function keys and electrical interfaces between said keys and said first, second and third selector valves and said first and second wing valves;

said keypad controller having a first, second and third mode of operation which are selectable with said mode key;

with said keypad controller in its first mode of operation, said first function key enables the powering of said first and third selector valves while said second selector valve and said first and second wing valves remain in their first positions, and said second function key enables the powering of said third selector valve while said first and second selector valves and said first and second wing valves remain in their first positions;

with said keypad controller in its second mode of operation, said first function key enables the powering of said second selector valve while said first and third selector valves and said first and second wing valves remain in their first positions, and said second function key enables the powering of said second selector valve and said first and second wing valves while said first and third selector valves remain in their first positions;

with said keypad controller in its third mode of operation, successive operation of said first function key alternately enables the powering of said first wing valve and said second selector valve while said first and third selector valves and said second wing valve remain in their first positions and thereafter interrupts the powering of said first wing valve while enabling power to said first selector valve and successive operation of said second function key alternately enables the powering of said second wing valve while said first, second, and third selector valves and said first wing valve remains in its first position and thereafter said first selector second and third selector valves and said first and second wing valves remain in their first positions.

23. The hydraulic system of claim 22 furthering including a third, lift hydraulic actuator connectable to the snowplow blade and having a rod and a base end;

a sixth, lift valve in communication with said second selector valve and said third, lift hydraulic actuator, said sixth, lift valve having a first flow control position, being moveable under power from said first position to a second flow control position, and returnable to said first position when said power is removed;

a third function key and a fourth function key on said keypad controller having electrical interfaces to said valves; and wherein with said keypad controller in either said first, second or third mode of operation, said third function key enables the powering of said first and second selector valves while said third selector valve, said first and second wing valves and said lift valve remain in their first position and said fourth function key enables the powering of said second selector valve and said sixth lift valve while said first and third selector valves and said first and second wing valves remain in first positions.

24. The hydraulic system of claim 22 wherein said keypad controller includes a timed interruption circuit activated when either of said first, second, or third function keys are operated deactivating the powering of said respective valves after a predetermined length of time has lapsed.

25. The hydraulic system of claim 22 wherein said keypad controller includes a delay function circuit which maintains powering of said respective valves for a predetermined time after said first, second, or third function keys have been activated.

26. The hydraulic system of claim 15 including a third lift hydraulic actuator connectable to the snowplow blade and having a rod and a base end, said third lift hydraulic actuator operative to raise and lower the blade;

a sixth lift valve;

said sixth lift valve having a first position, under power moveable from said first position to a second position, and returnable to said first position when said power is removed;

said sixth lift valve in its first position establishing a hydraulic fluid flow connection from said second selector valve to said base side of said third lift hydraulic actuator and blocking hydraulic fluid flow from said base side of said third hydraulic actuator to said second selector valve;

said sixth lift valve in its second position establishing a hydraulic fluid flow path from said base side of said third lift hydraulic actuator to said second selector valve;

a controller operative to power said first and second selector valves while said third selector valve and said first and second wing valves remain in their first positions and to power said second selector valve and lift valve while said first and third selector valves and said first and second wing valves remain in said first positions whereby said system enables the snowplow blade to be alternatively raised and lowered.

27. The hydraulic system of claim 15 including a first and second check valve positioned between said third selector valve and said reservoir;

a third check valve in said first connection;

a fourth check valve in said second connection; and whereby said check valves enable said system to hold the snowplow blade in a selected configuration and position.

* * * * *

UNITED STATES PATENT AND TRADEMARK OFFICE

CERTIFICATE OF CORRECTION

PATENT NO. : 6,253,470 B1
DATED : July 3, 2001
INVENTOR(S) : Gerald L. Depies, Jerald L. Plyer, Charles J. Solveson It is certified that error appears in the above-identified patent and that said Letters Patent is hereby corrected as shown below:

Column 6,
Line 56, before "fifth" insert -- scoop or --;
Line 57, delete "scoop or"; and
Line 60, before "selector", insert -- second --.

Column 7,
Line 36, delete "86,"; and
Line 37, delete "88, 90 and 92".

Column 8,
Line 32, delete "valve 90" and insert -- valve 92 --.

Column 9,
Line 7, delete "selectro" and insert -- selector --.

Column 18, claim 10,
Line 33, delete "right" and insert -- right --.

Signed and Sealed this

Second Day of April, 2002

*Attest:*

*Attesting Officer*

JAMES E. ROGAN
*Director of the United States Patent and Trademark Office*